US009036856B2

(12) United States Patent
Takeda et al.

(10) Patent No.: US 9,036,856 B2
(45) Date of Patent: May 19, 2015

(54) SOUND REPRODUCTION DEVICE

(71) Applicant: PANASONIC CORPORATION, Osaka (JP)

(72) Inventors: Katsu Takeda, Osaka (JP); Fumiyasu Konno, Osaka (JP); Kazuhisa Kotegawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/196,632

(22) Filed: Mar. 4, 2014

(65) Prior Publication Data

US 2014/0254811 A1 Sep. 11, 2014

(30) Foreign Application Priority Data

Mar. 5, 2013 (JP) ..... 2013-042564

(51) Int. Cl.
*H04R 29/00* (2006.01)
*H04S 7/00* (2006.01)
*H04R 5/02* (2006.01)

(52) U.S. Cl.
CPC . *H04S 7/303* (2013.01); *H04R 5/02* (2013.01); *H04R 2201/025* (2013.01); *H04R 2205/024* (2013.01); *H04R 2217/03* (2013.01)

(58) Field of Classification Search
CPC .... H04R 29/00; H04R 29/001; H04R 29/007; H04R 2201/02; H04R 2201/025; H04R 1/02; H04R 1/20; H04R 1/26; H04R 5/02
USPC ..... 381/303, 300, 58, 59, 304, 386, 387
See application file for complete search history.

(56) References Cited

U.S. PATENT DOCUMENTS

| | | | |
|---|---|---|---|
| 4,832,489 | A | 5/1989 | Wyant et al. |
| 5,708,719 | A | 1/1998 | Greenberger et al. |
| 5,930,370 | A | 7/1999 | Ruzicka |
| 2004/0247140 | A1 | 12/2004 | Norris et al. |
| 2007/0183618 | A1 | 8/2007 | Ishii et al. |
| 2013/0163795 | A1 | 6/2013 | Takeda et al. |

FOREIGN PATENT DOCUMENTS

| | | | |
|---|---|---|---|
| JP | 11-004500 | A | 1/1999 |
| JP | 2000-036993 | A | 2/2000 |
| JP | 2006-135779 | A | 5/2006 |
| JP | 2006-352571 | A | 12/2006 |
| JP | 2008-252625 | A | 10/2008 |
| JP | 2012-029096 | A | 2/2012 |
| WO | 2005/076661 | A1 | 8/2005 |
| WO | 2012/032704 | A1 | 3/2012 |

*Primary Examiner* — Brian Ensey
*Assistant Examiner* — Sabrina Diaz
(74) *Attorney, Agent, or Firm* — McDermott Will & Emery LLP

(57) ABSTRACT

Provided is a sound reproduction device including: a first loudspeaker having directionality utilizing a parametric effect; a second loudspeaker having directionality broader than that of the first loudspeaker; an orientation adjustment unit configured to change an orientation of the first loudspeaker; an information obtaining device configured to obtain positional information of a listener; and a drive controller electrically connected to the first loudspeaker, the second loudspeaker, the orientation adjustment unit, and the information obtaining device, and configured to control the orientation of the first loudspeaker based on the positional information of the listener.

10 Claims, 13 Drawing Sheets

SOUND REPRODUCTION DEVICE

RELATED APPLICATIONS

This application claims the benefit of Japanese Application No. 2013-042564, filed on Mar. 5, 2013, the disclosure of which is incorporated by reference herein.

BACKGROUND

1. Technical Field

The present disclosure relates to a sound reproduction device using narrow-directivity loudspeakers utilizing a parametric effect.

2. Description of the Related Art

FIG. 12 is a block diagram of conventional sound reproduction device 130, in which loudspeaker 111 that is a wide-directivity loudspeaker and superdirective loudspeaker 113 that is a narrow-directivity loudspeaker are placed in parallel with each other. Loudspeaker 111 is configured such that a sound pressure of audible sound from loudspeaker 111 decreases as distance d along a sound axis increases. When superdirective loudspeaker 113 faces a listener, a sound pressure of audible sound from superdirective loudspeaker 113 is maximized at predetermined distance dk from superdirective loudspeaker 113 along the sound axis. A position at which the sound pressure of the audible sound is maximized (the position of the maximum sound pressure) corresponds to listening point 126. Sound field 123 of the audible sound from loudspeaker 111 and sound field 125 of the audible sound from superdirective loudspeaker 113 overlap with each other at listening point 126. Here, superdirective loudspeaker 113 uses an ultrasonic wave as a carrier wave.

Loudspeaker 111 is electrically connected to sound source 119 such as a television set tuner, a CD player, and a DVD player via amplifier circuit 117. Superdirective loudspeaker 113 is electrically connected to sound source 119 via drive circuit 121.

Next, a sound pressure characteristic of sound reproduction device 130 will be described. FIG. 13A is a sound pressure characteristic diagram of audible sound of conventional sound reproduction device 130, with respect to distance d along the sound axis. FIG. 13A shows a relation of sound pressures of the audible sound from loudspeaker 111 and superdirective loudspeaker 113 with respect to distance d (along the sound axis) between a position at which loudspeaker 111 and superdirective loudspeaker 113 are placed and any point between the placement position and listening point 126. A horizontal axis (distance d along the sound axis) in FIG. 13A corresponds to a portion indicated by line Y-Y in FIG. 12. Further, a vertical axis in FIG. 13A shows sound pressures that are normalized respectively taking a maximum sound pressure of the audible sound from loudspeaker 111 and a maximum sound pressure of the audible sound from superdirective loudspeaker 113 as 1. The sound pressure of the audible sound from loudspeaker 111 is indicated by a dotted line, the sound pressure of the audible sound from superdirective loudspeaker 113 is indicated by a dashed line, and a combined sound pressure is indicated by a solid line.

Referring to FIG. 13A, the sound pressure of the audible sound from loudspeaker 111 is maximized at the position at which loudspeaker 111 is placed and decays as distance d along the sound axis increases. On the other hand, the sound pressure of the audible sound from superdirective loudspeaker 113 is small at the position at which superdirective loudspeaker 113 is placed, increases as distance d along the sound axis increases, is maximized at predetermined distance dk, and then decreases as distance d further increases. A sound pressure of sound superimposing the audible sound from loudspeaker 111 and superdirective loudspeaker 113 (combined sound pressure) is indicated by the solid line in FIG. 13A.

As shown in FIG. 13A, the sound pressures of the audible sound emitted from loudspeaker 111 and superdirective loudspeaker 113 are heard largest when the listener is positioned at predetermined distance dk along the sound axis from the position at which these loudspeakers are placed, and becomes smaller if the listener is away from predetermined distance dk.

Now, FIG. 13B shows a sound pressure characteristic of the audible sound with respect to distance w which is vertical to the sound axis (a portion indicated by line X-X in FIG. 12). Here, a vertical axis in FIG. 13B is the same as the vertical axis in FIG. 13A. The sound pressure of the audible sound from loudspeaker 111 is indicated by a dotted line, the sound pressure of the audible sound from superdirective loudspeaker 113 is indicated by a dashed line, and a combined sound pressure is indicated by a solid line. The sound pressure of loudspeaker 111 is maximized on the sound axis, and gradually decreases as distance w in a direction vertical to the sound axis increases. By contrast, the sound emitted from superdirective loudspeaker 113 has high directionality. Therefore, the sound pressure of the sound emitted from superdirective loudspeaker 113 is maximized on the sound axis. Further, in the direction vertical to the sound axis, the sound pressure of the sound emitted from superdirective loudspeaker 113 drops steeply as distance w increases. Thus, the sound pressures of the audible sound from loudspeaker 111 and from superdirective loudspeaker 113 (combined sound pressure) show a characteristic as shown by a solid line in FIG. 13B.

Combined sound pressure characteristics of the audible sound shown in FIG. 13A and FIG. 13B are shown in FIG. 14. As illustrated in FIG. 14, the peaks of the sound pressures correspond to listening point 126 both along the sound axis and in the direction vertical to the sound axis.

Further, a sound field realized by the conventional sound reproduction device is a sound field where the sound field of loudspeaker 111 overlaps with the sound field of the audible sound from superdirective loudspeaker 113 that reproduces the audible sound using an ultrasonic wave as a carrier wave. Therefore, a proportion of interference between the audible sound in the sound fields of loudspeaker 111 and of superdirective loudspeaker 113 is reduced as compared to that between sound fields produced from the conventional loudspeakers. Consequently, the listener is able to listen to the sound from superdirective loudspeaker 113 clearly, without being influenced by the sound from loudspeaker 111.

As described above, it is possible to realize a three-dimensional sound field that allows the listener to obtain a feeling that the listener is surrounded by sound, only with loudspeaker 111 and superdirective loudspeaker 113 that are placed in the same direction with respect to the listener, without providing a large number of loudspeakers around the listener.

As an example of the sound reproduction device using a wide-directivity loudspeaker and a narrow-directivity loudspeaker, International Publication No. WO2012/032704 is known.

SUMMARY

A sound reproduction device according to one aspect of the present disclosure includes: a first loudspeaker having directionality utilizing a parametric effect; a second loudspeaker having directionality broader than that of the first loudspeaker; an orientation adjustment unit configured to change an orientation of the first loudspeaker; an information obtaining device configured to obtain positional information of a listener; and a drive controller electrically connected to the first loudspeaker, the second loudspeaker, the orientation adjustment unit, and the information obtaining device, and configured to control the orientation of the first loudspeaker based on the positional information of the listener. Here, the drive controller controls the orientation adjustment unit so that if a distance between the first loudspeaker and the listener is determined to be shorter than a distance between the first loudspeaker and a position of a peak of a sound pressure of audible sound in a state in which the first loudspeaker faces the listener, the orientation adjustment unit changes the orientation of the first loudspeaker in such a manner that the first loudspeaker changes from a state in which audible sound from the first loudspeaker directly reaches the listener to a state in which the audible sound from the first loudspeaker reaches the listener via a reflection surface.

According to the present disclosure, the orientation adjustment unit is able to change the orientation of the first loudspeaker and allows the audible sound produced from the first loudspeaker to reach the listener via the reflection surface. Therefore, even when the listener is at the position that is closer to the first loudspeaker than the position of the peak of the sound pressure of the audible sound from the first loudspeaker is, it is possible to make the peak of the sound pressure of the audible sound closer to the listener's position. Thus, it is possible to achieve an advantageous effect that a sound reproduction device capable of easily providing a three-dimensional effect may be provided.

DETAILED DESCRIPTION OF THE PREFERRED EMBODIMENT

Problems of the conventional sound reproduction device will be first described before describing an exemplary embodiment.

Figure 12:
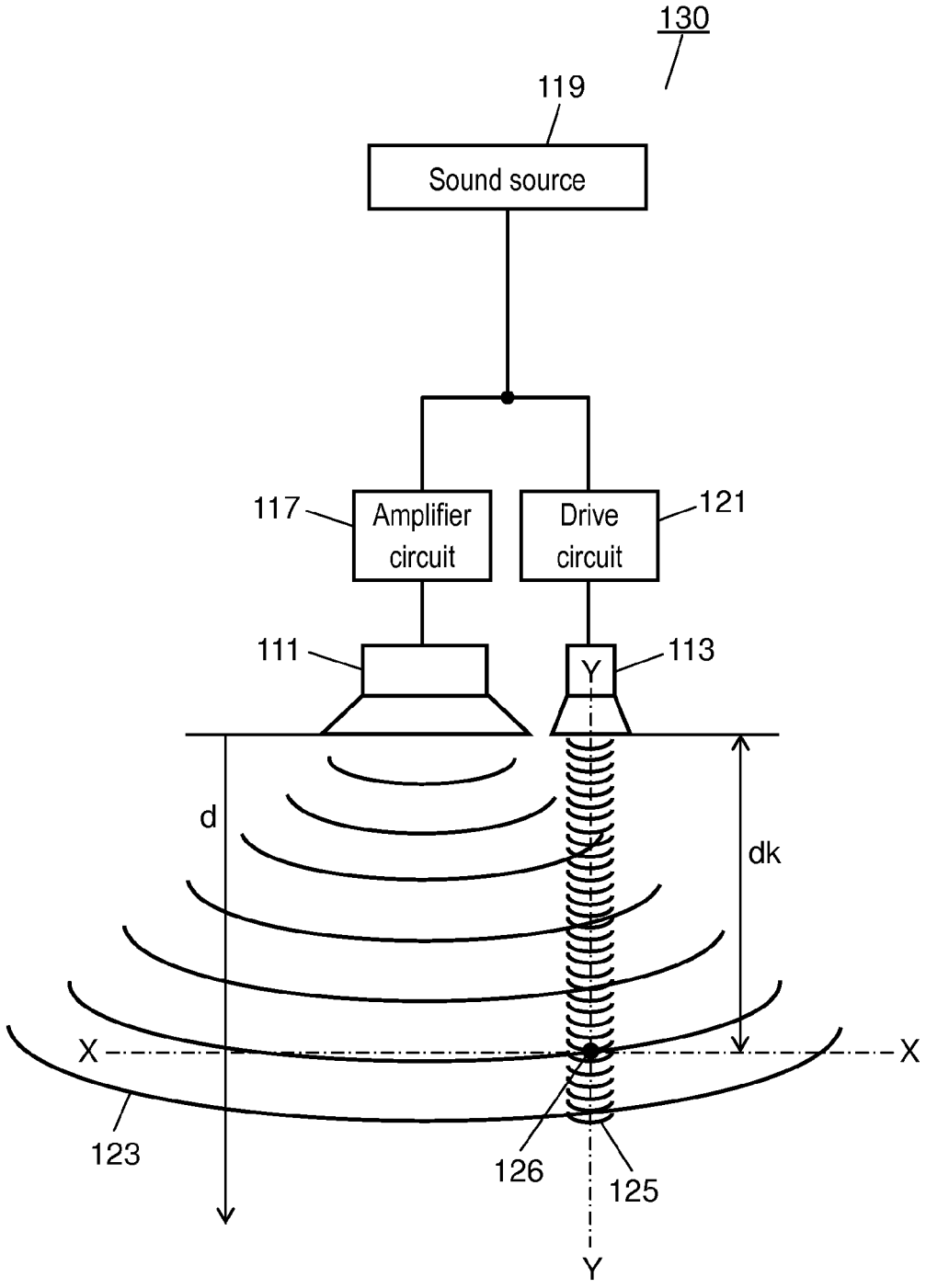
FIG. 12 Prior Art
FIG. 12 is a block diagram of a conventional sound reproduction device.
Figure 13A:
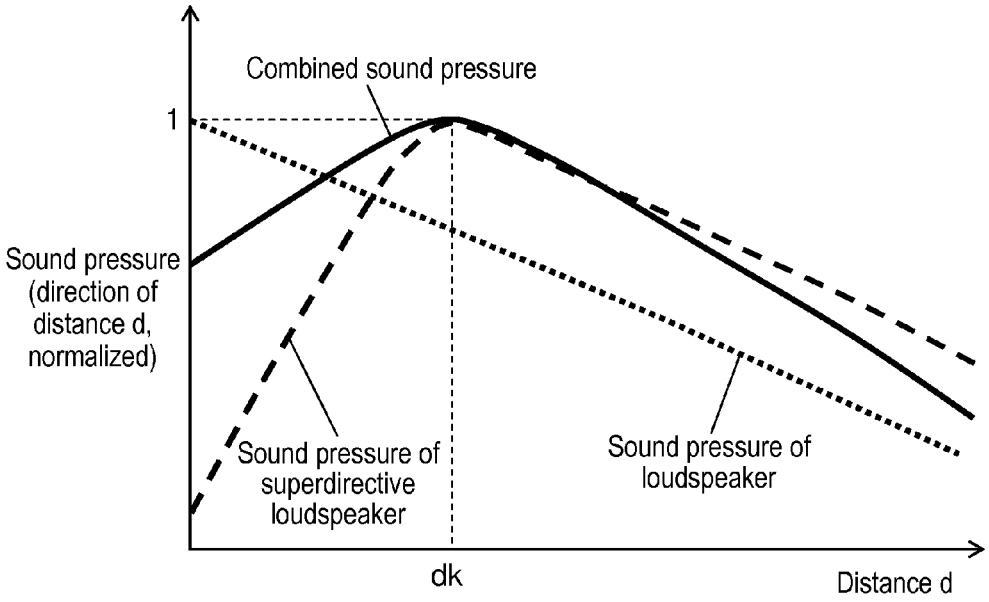
FIG. 13A Prior Art
FIG. 13A is a sound pressure characteristic diagram of audible sound of the conventional sound reproduction device, with respect to distance d along a sound axis.
Figure 13B:
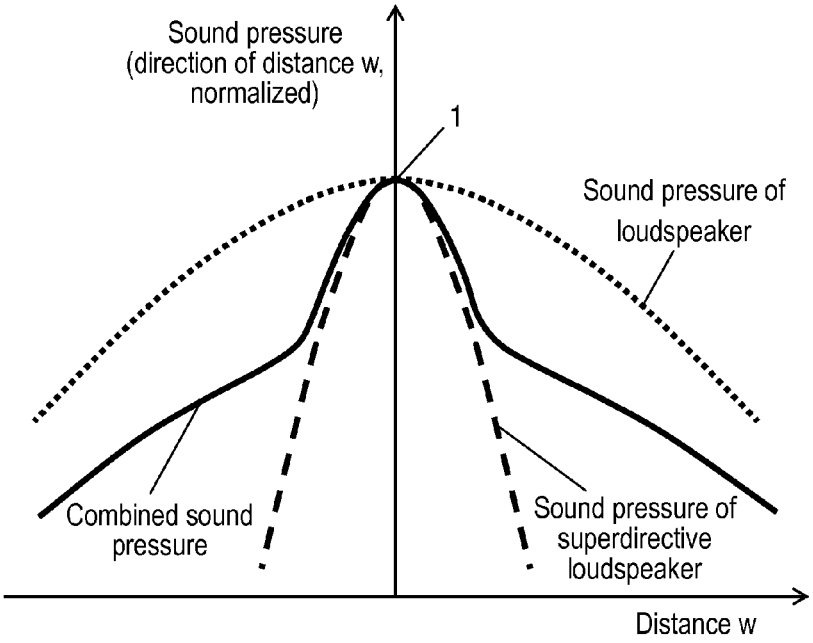
FIG. 13B Prior Art
FIG. 13B is a sound pressure characteristic diagram of the audible sound of the conventional sound reproduction device, with respect to distance w in the direction vertical to the sound axis.
Figure 14:
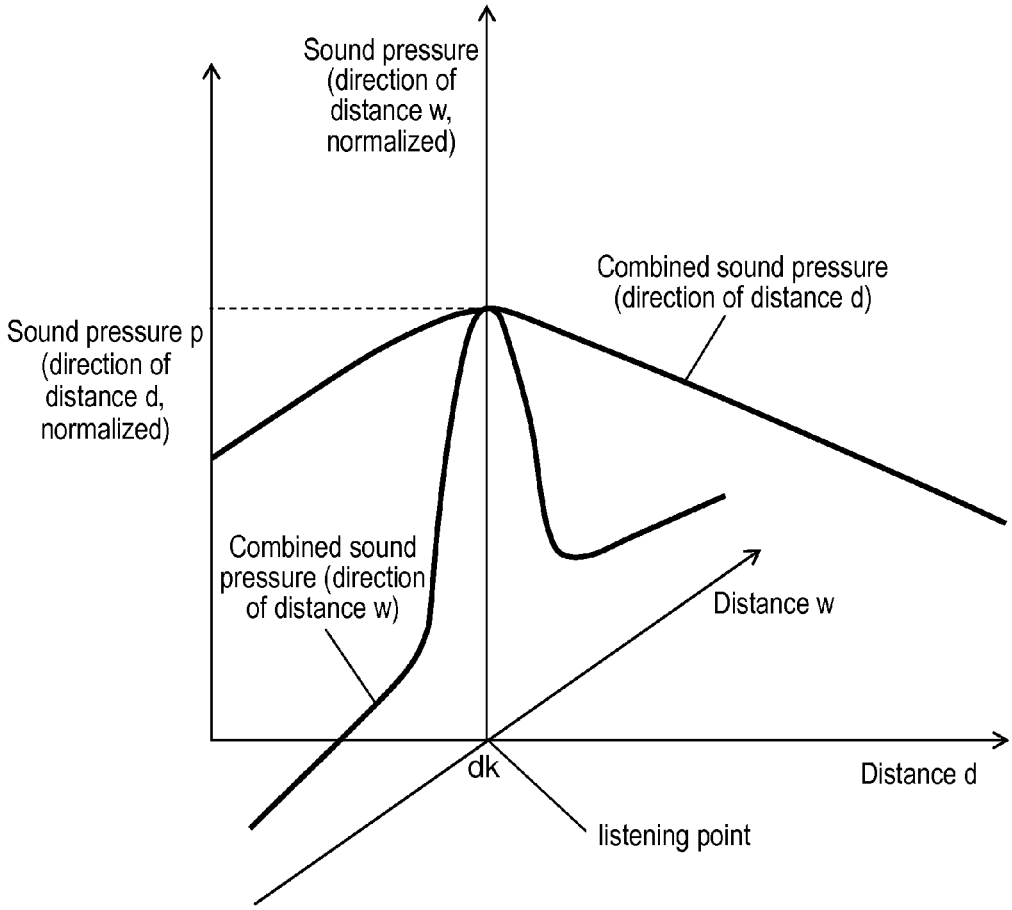
FIG. 14 Prior Art
FIG. 14 is a sound pressure characteristic diagram of audible sound of the conventional sound reproduction device, with respect to distance d along the sound axis and distance w in the direction vertical to the sound axis.

The sound reproduction device described with reference to FIG. 12 through FIG. 14 may provide a listener with a three-dimensional effect without arranging a large number of loudspeakers. However, there is a problem that the three-dimensional effect may not be effectively provided unless the listener is positioned at listening point 126. Specifically, as the sound pressures of loudspeaker 111 and superdirective loudspeaker 113 have the characteristics as shown in FIG. 14, the sound pressures decrease largely if the listener is at a position away from listening point 126. This possibly results in a case in which a sound field that allows the listener to sufficiently obtain the three-dimensional effect may not be formed. Further, there is a problem that it is difficult for the listener to be positioned near listening point 126 as the sound pressures of loudspeaker 111 and superdirective loudspeaker 113 are complicated as shown in FIG. 14.

An object of the present invention is to provide a sound reproduction device that allows a listener to easily obtain a three-dimensional effect.

Hereinafter, the exemplary embodiment of the present invention will be described with reference to the drawings.

Exemplary Embodiment

Figure 1:
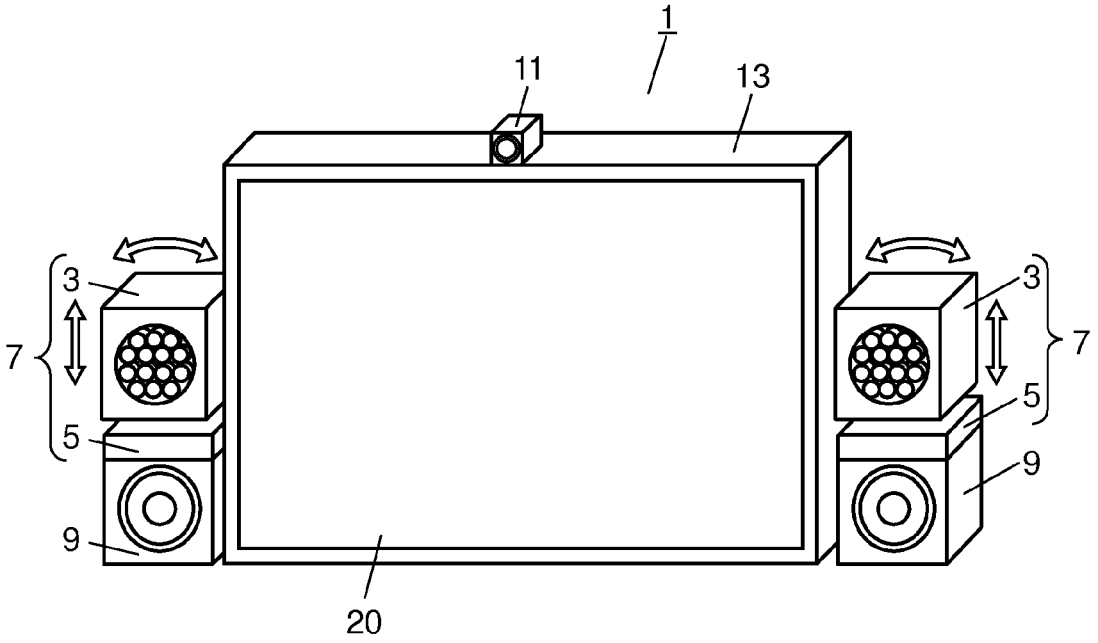
FIG. 1 is a schematic diagram of a configuration of a sound reproduction device according to an exemplary embodiment of the present invention.
Figure 2:
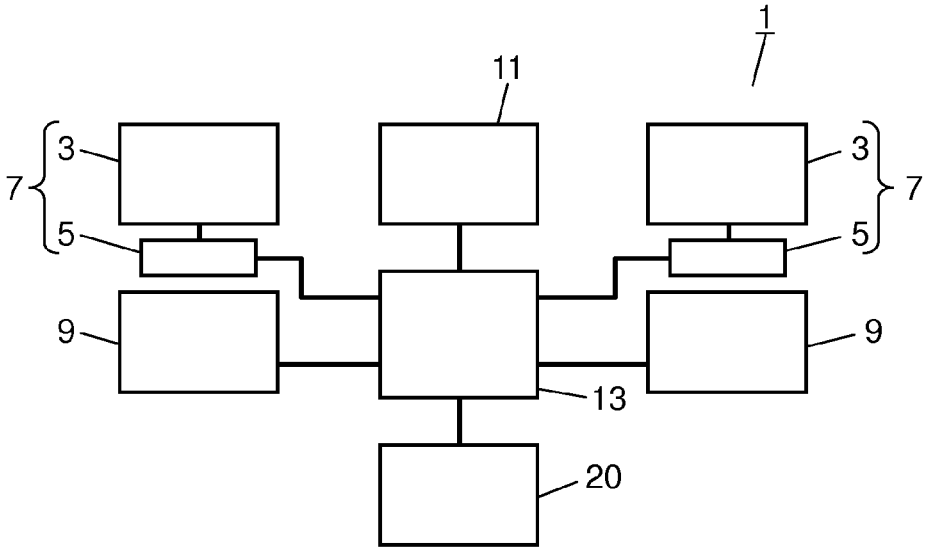
FIG. 2 is a block diagram of the sound reproduction device according to the exemplary embodiment of the present invention.

FIG. 1 is a schematic diagram of a configuration of sound reproduction device 1 according to the exemplary embodiment. FIG. 2 is a block diagram of sound reproduction device 1 according to the exemplary embodiment. Sound reproduction device 1 according to the exemplary embodiment includes superdirective loudspeaker 3 (first loudspeaker) having directionality utilizing a parametric effect, loudspeaker 9 (second loudspeaker) having directionality broader than that of superdirective loudspeaker 3, orientation adjustment unit 5, information obtaining device 11, and drive controller 13. Orientation adjustment unit 5 changes an orientation of superdirective loudspeaker 3. Information obtaining device 11 obtains information including positional information of the listener. Drive controller 13 is electrically connected to superdirective loudspeaker 3, loudspeaker 9, orientation adjustment unit 5, and information obtaining device 11. Drive controller 13 causes orientation adjustment unit 5 to change the orientation of superdirective loudspeaker 3 so that a peak of a sound pressure of audible sound produced from superdirective loudspeaker 3 comes closer to the listener's position.

Further, when the listener's position is closer to superdirective loudspeaker 3 than a position of the peak of the sound pressure of the audible sound produced from superdirective loudspeaker 3, drive controller 13 causes orientation adjustment unit 5 to change the orientation of superdirective loudspeaker 3 and has the audible sound produced from superdirective loudspeaker 3 reflect on a predetermined reflection surface, and thus the position of the peak is moved closer to the listener's position.

With the above configuration, it is possible to achieve an advantageous effect that a sound reproduction device capable of easily providing a three-dimensional effect may be provided, even when the listener is at a position that is closer to superdirective loudspeaker 3 than the position of the peak of the sound pressure of the audible sound produced from superdirective loudspeaker 3.

Further, drive controller 13 controls superdirective loudspeaker 3 (first loudspeaker) based on the positional information of the listener so that a sound field of the audible sound from superdirective loudspeaker 3 overlaps with a sound field of the audible sound from loudspeaker 9 at the listener's position.

Hereinafter, the configuration of sound reproduction device 1 according to the exemplary embodiment will be described in detail.

In this exemplary embodiment, sound reproduction device 1 having two superdirective loudspeakers 3 and two loudspeakers 9 will be taken as an example. It should be appreciated that the numbers of superdirective loudspeakers 3 and loudspeakers 9 are not limited to two, and may be one, three, or even more.

Superdirective loudspeaker unit 7 is configured by superdirective loudspeaker 3 and orientation adjustment unit 5.

Further, drive controller 13 causes orientation adjustment unit 5 to change the orientation of superdirective loudspeaker 3 so that the sound field of the audible sound from superdirective loudspeaker 3 overlaps with the sound field of the audible sound from loudspeaker 9 at the listener's position. As a result, it is possible to realize the sound reproduction device with which the three-dimensional effect may be easily produced for the listener.

In practice, orientation adjustment unit 5 changes the orientation of superdirective loudspeaker 3 by drive controller 13 controlling orientation adjustment unit 5.

In this exemplary embodiment, a narrow-directivity loudspeaker using an ultrasonic wave as a carrier wave is defined as superdirective loudspeaker 3, and a conventional loudspeaker having directionality broader than the narrow-directivity loudspeaker and not using an ultrasonic wave is defined as loudspeaker 9.

As described with reference to FIG. 13A, the sound pressure of conventional loudspeaker 9 that reproduces the audible sound as it is without using an ultrasonic wave is maximized at the position of loudspeaker 9, and decreases as the sound travels farther away from speaker loudspeaker 9. On the other hand, the sound pressure of the audible sound of superdirective loudspeaker 3 has the peak at a predetermined distance from superdirective loudspeaker 3.

Figure 3:
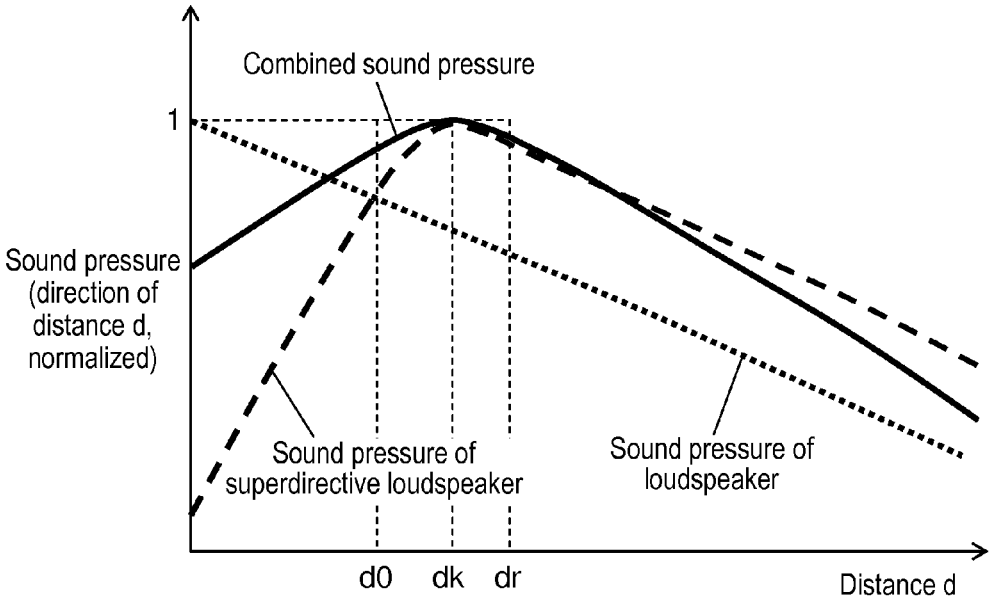
FIG. 3 is a sound pressure characteristic diagram of audible sound of the sound reproduction device according to the exemplary embodiment of the present invention, with respect to distance d along a sound axis.

Typically, when a sound wave with increased amplitude is emitted to a medium such as air or water, elastic characteristics of the medium itself (a volume change against a pressure change) gains a non-linear, instead of linear, as the sound wave travels through the medium. Therefore, a waveform of the sound wave is distorted, and consequently the sound wave has come to contain a frequency component that is not originally contained. Such a characteristic is called a parametric phenomenon, or the parametric effect of the sound wave. FIG. 3 is a sound pressure characteristic diagram of the audible sound of the sound reproduction device according to the exemplary embodiment of the present invention, with respect to distance d along a sound axis. Superdirective loudspeaker 3 utilizes such a characteristic (the parametric effect). When an audible sound component of superdirective loudspeaker 3 is superimposed over an ultrasonic wave and emitted, the waveform of the ultrasonic wave as the carrier wave is distorted as it travels through the air due to an influence of the non-linearity of the elastic characteristics of the air. Further, since the ultrasonic component having a higher frequency starts to decay first, the audible sound component having a frequency with respect to that of the ultrasonic wave and superimposed over the ultrasonic wave is reproduced. As a result, as illustrated in FIG. 3, the sound pressure of superdirective loudspeaker 3 shows its peak at predetermined distance dk.

Further, generally speaking regarding directionality of the sound wave, as the frequency of the sound wave is higher, the sound wave propagates without spreading from the sound axis, and therefore a radiation angle becomes smaller and the directionality increases. Accordingly, directionality of the sound wave emitted from superdirective loudspeaker 3 using, as a carrier wave, the ultrasonic wave having a frequency higher than that of the audible sound is high. Thus, directionality of the audible sound generated in the process of propagation of the ultrasonic wave under the influence of the non-linear characteristic of air is also high.

Orientation adjustment unit 5 is configured by a motor and a gear (either is not shown), controlled by a signal from drive controller 13, and moves superdirective loudspeaker 3 up, down, right, and left as shown by thick arrows in FIG. 1.

Information obtaining device 11 obtains information of the listener. In this exemplary embodiment, image information of an image of the listener (not shown) taken by a camera is obtained as the information of the listener. This information includes the positional information of the listener.

Further, superdirective loudspeaker 3, orientation adjustment unit 5, loudspeaker 9, and information obtaining device 11 are electrically connected to drive controller 13. In this exemplary embodiment, there are provided two superdirective loudspeakers 3 and two loudspeakers 9 on left and right. In addition, drive controller 13 includes an amplifier circuit that amplifies audio signals respectively outputted to superdirective loudspeakers 3 and loudspeakers 9 on left and right.

Drive controller 13 determines the listener who is attempting to obtain sound information from sound reproduction device 1, based on the image information obtained by information obtaining device 11. Further, drive controller 13 also determines linear distance d0 from superdirective loudspeaker 3 to the listener. In addition, drive controller 13 compares a level of the sound pressure at linear distance d0 to the listener with a level of the sound pressure at distance dk corresponding to the peak of the sound pressure.

Then, when linear distance d0 to the listener is determined to be shorter than distance dk corresponding to the peak of the sound pressure, drive controller 13 causes orientation adjustment unit 5 to change the orientation of superdirective loudspeaker 3 and has the audible sound produced from superdirective loudspeaker 3 reflect on the reflection surface. Specifically, the audible sound produced from superdirective loudspeaker 3 reaches the listener via the reflection surface.

Therefore, the listener hears the reflected sound. With this configuration, the distance for the audible sound produced from superdirective loudspeaker 3 to reach the listener may become longer than linear distance d0. Consequently, according to the sound reproduction device of this exemplary embodiment, the position of the peak of the audible sound produced from superdirective loudspeaker 3 may become closer to the listener's position. As a result, even when the listener is at the position that is closer to superdirective loudspeaker 3 than the position of the peak of the sound pressure of the audible sound produced from superdirective loudspeaker 3, it is possible to easily provide the three-dimensional effect for the listener.

Here, information obtaining device 11 measures the linear distance between information obtaining device 11 and the listener, and the distance between information obtaining device 11 and the reflection surface. For example, when a camera is used as information obtaining device 11, the camera takes an image of the listener and the reflection surface. Then, information obtaining device 11 outputs, to drive controller 13, a focus distance when the image of the listener and the reflection surface is taken. Subsequently, drive controller 13 uses the information to calculate the distance between superdirective loudspeaker 3 and the listener, and the distance between superdirective loudspeaker 3 and the reflection surface. In addition, drive controller 13 determines the orientation of orientation adjustment unit 5 based on the calculated distance, such that the position of the peak of the audible sound produced by superdirective loudspeaker 3 becomes closer to the listener's position.

Examples of the reflection surface include a floor, a ceiling, and walls of a place in which sound reproduction device 1 is placed. The reflection surface may be, but not limited to, any member that reflects sound. For example, ground, furniture, or glass windows may be used.

When an environment in which the listener listens is a standard house, it is probable that the reflected sound may not reach the listener because furniture is disposed along the walls. Further, a carpet or the like is often laid on the floor. The sound is not easily reflected on the carpet. Accordingly, when sound reproduction device 1 is placed within a standard house, it is preferable to use a ceiling as the reflection surface. This is because ceilings are generally flat and provided only with lamps and such.

When the ceiling is used as the reflection surface, it is preferable that superdirective loudspeaker 3 is placed at a position as high as possible. For example, when there are a shelf or a desk between sound reproduction device 1 and the listener, it is preferable that superdirective loudspeaker 3 is placed at a position higher than a top panel of the shelf or the desk. By placing superdirective loudspeaker 3 at the high position, sound outputted from superdirective loudspeaker 3 is not blocked by the shelf or the desk. Further, it is possible to use the top panel of the shelf or the desk as the reflection surface.

On the other hand, when sound reproduction device 1 is used while being placed in an environment in which there is no ceiling or walls such as an outdoor environment, or an environment having a high ceiling such as a vaulted ceiling, it is preferable to use a floor or the ground as the reflection surface.

The number of the reflection surfaces is not limited to one. The sound outputted from superdirective loudspeaker 3 may be reflected upon a plurality of reflection surfaces before reaching the listener. In addition, the sound may be reflected upon the same reflection surface more than once.

As shown in FIG. 1, sound reproduction device 1 further includes image display device 20. Image display device 20 is configured as a display device such as a liquid crystal display, a plasma display, or an organic EL display. Image display device 20 may be a television having a built-in tuner. Further, according to this exemplary embodiment, image display device 20 has built-in drive controller 13. Image display device 20 is electrically connected to drive controller 13.

Figure 4:
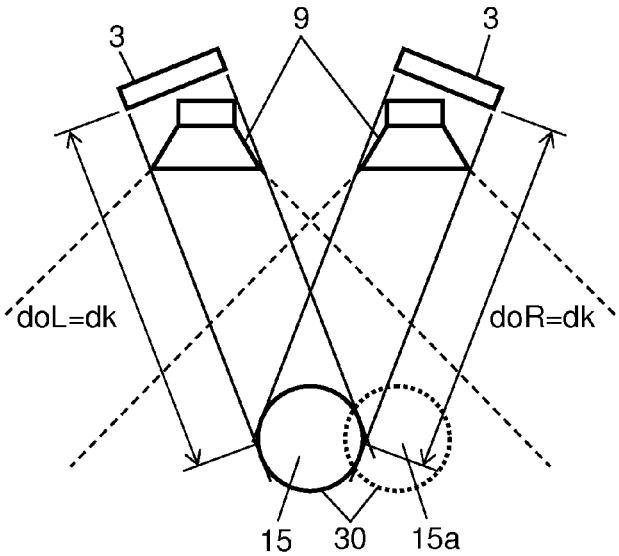
FIG. 4 is a conceptual diagram illustrating a positional relation between a sound field produced by the sound reproduction device according to the exemplary embodiment of the present invention and a listener.

FIG. 4 is a conceptual diagram illustrating a positional relation between the sound field produced by sound reproduction device 1 according to the exemplary embodiment and the listener. FIG. 4 shows the positional relation between the sound fields of superdirective loudspeaker 3 and loudspeaker 9 that configure sound reproduction device 1 and the listener. Regarding the positions of superdirective loudspeaker 3 and loudspeaker 9, superdirective loudspeaker 3 is shown behind loudspeaker 9 in the drawing for the sake of clarity, and image display device 20 is not shown.

As described above, the radiation angle of the sound from superdirective loudspeaker 3 is narrow. In addition, when the sound outputted from superdirective loudspeaker 3 directly reaches the listener, the sound field produced by superdirective loudspeaker 3 is a narrow area encircled by a solid line. On the other hand, since loudspeaker 9 has the radiation angle of the sound broader than that of superdirective loudspeaker 3, the sound field produced by loudspeaker 9 is a broad area between dashed lines.

Further, the sound field of superdirective loudspeaker 3 near the listener when the sound outputted from superdirective loudspeaker 3 reaches the listener after reflecting on the reflection surface is the narrow area encircled by the solid line similarly to the sound field shown in FIG. 4. Then, listener 30 is able to obtain the three-dimensional effect of the sound by positioning at a portion where the sound fields of superdirective loudspeaker 3 and loudspeaker 9 overlap with each other.

Hereinafter, an operation of sound reproduction device 1 providing such a three-dimensional effect will be described. Orientation adjustment unit 5 of superdirective loudspeaker unit 7 is attached to an upper part of loudspeaker 9 as illustrated in FIG. 1. Further, loudspeaker 9 is attached to image display device 20 with a gap with which the orientation of superdirective loudspeaker 3 may be changed between a left and a right direction.

An optimal listening/viewing position for image display device 20 is previously determined depending on the size of the screen. Accordingly, the position of superdirective loudspeaker unit 7 is adjusted at the time of factory default, such that the peak of the sound pressure of the audible sound produced from each of the plurality of superdirective loudspeakers 3 falls on the listening/viewing position and that the sound field of the audible sound produced from loudspeakers 9 falls on the listening/viewing position. As shown in FIG. 4, sound reproduction device 1 is configured such that listener 30 is able to obtain sound information having a favorable three-dimensional effect when linear distance d0R between right one of superdirective loudspeakers 3 and a right ear of listener 30, and linear distance d0L between left one of superdirective loudspeaker 3 and a left ear of listener 30 are both distance dk. In the following, a position at which d0 is equal to dk is referred to as optimal position 15, and a state in which the listener is at optimal position 15 is referred to as an optimal state.

Further, the three-dimensional effect is attributed to the fact that the sound information of superdirective loudspeaker 3 and the sound information of loudspeaker 9 do not easily interfere with each other. While the sound of loudspeaker 9 is the audible sound reproduced therefrom, superdirective loudspeaker 3 reproduces the audible sound by utilizing the nonlinearity of the elastic characteristics of the air taking an ultrasonic wave, for example, of 40 kHz as a carrier wave. Accordingly, a difference between frequencies of main components of loudspeaker 9 and superdirective loudspeaker 3 is large, and an interference therebetween may not easily occur. Therefore, listener 30 is able to listen to the sound from superdirective loudspeaker 3 as sound with less interference even in the sound field of loudspeaker 9. Based on such characteristics of loudspeaker 9 and superdirective loudspeaker 3, listener 30 is able to obtain sound information having a three-dimensional effect when listener 30 is at predetermined distance dk. As one example of superdirective loudspeaker 3, predetermined distance dk is about 2 m when a carrier wave frequency is 40 kHz.

Next, a case in which listener 30 is listening at a position displaced from optimal position 15 will be described with reference to FIG. 4. A case in which listener 30 is at position 15*a* slightly displaced from optimal position 15 in a rightward direction will be described as one example. When the listener is at position 15*a*, the sound from superdirective loudspeaker 3 is heard small for listener 30 because the radiation angle of the sound from superdirective loudspeaker 3 is narrow.

In this case, drive controller 13 first analyzes an image from information obtaining device 11 based on face image recognition or the like, and obtains the position of listener 30 (listening point). Drive controller 13 previously records various data such as predetermined distance dk and the sound pressure characteristics shown in FIG. 3 in a built-in memory (not shown). Drive controller 13 obtains linear distance d0 to the listener based on focusing operation information of the image from information obtaining device 11. At the same time, drive controller 13 also obtains the direction and the degree of the position of the listener with respect to the center of the image from information obtaining device 11. Further, the distance between information obtaining device 11 and each of superdirective loudspeakers 3 is known and recorded in the built-in memory. Based on the above facts, drive controller 13 calculates the distance and the direction from each superdirective loudspeaker 3 to the listener.

Next, drive controller 13 calculates an amount by which each of superdirective loudspeakers 3 is to be moved in order to change predetermined distance dk from each of superdirective loudspeakers 3, that is, the peak of the sound pressure of the audible sound produced from each superdirective loudspeaker 3 to be closer to the position of listener 30. Specifically, drive controller 13 calculates an amount by which superdirective loudspeakers 3 are to be moved, based on the position of listener 30 and the various data recorded in the built-in memory.

Further, drive controller 13 calculates an amount by which each of superdirective loudspeakers 3 is to be moved in order to have the sound field of the audible sound produced from loudspeaker 9 overlap with the sound field of the audible sound produced from superdirective loudspeaker 3 at the position of listener 30 at a position with the distance to the listener, based on the sound pressure characteristics shown in FIG. 3. Then, drive controller 13 outputs a control signal to each of orientation adjustment units 5. As a result, each orientation adjustment unit 5 directs corresponding superdirective loudspeaker 3 to face a direction obtained based on the calculation results by drive controller 13. With the above operation, listener 30 is able to easily obtain the three-dimensional effect even at the position displaced leftward or rightward from the optimal state. In addition, listener 30 is able to obtain the three-dimensional effect continuously even when the listener moves leftward or rightward from the optimal state while listening.

Further, according to the exemplary embodiment, since there are two superdirective loudspeaker units 7, it is possible to reproduce the sound information of different sound sources respectively at the left ear and the right ear of listener 30. As a result, combined with the output from two loudspeakers 9, a surround sound effect in which listener 30 is surrounded by the sound information may be maintained, even when the position of listener 30 is displaced.

In this case, since linear distance d0L is longer than linear distance d0R, at the listener's position, a difference is produced between the levels of the sound pressures of superdirective loudspeaker 3 on the left and right. Therefore, the amplifier circuit of drive controller 13 adjusts amplification degrees of the sounds on the left and right so that the sound pressures of superdirective loudspeaker 3 on the left and right become equal at the listener's position.

As described above, even when there is only one pair of superdirective loudspeaker 3 and loudspeaker 9, the sound pressure characteristics produced by this pair of loudspeakers are complicated as shown in FIG. 14. The sound pressure characteristics produced by the loudspeakers become even more complicated when there are two pairs of superdirective loudspeaker 3 and loudspeaker 9. This makes it further difficult to position listener 30 at an optimal listening point for both sets of the loudspeakers. According to the exemplary embodiment, drive controller 13 automatically adjust the directions of two superdirective loudspeakers 3 according to the movement of listener 30. Therefore, even if there are a plurality of superdirective loudspeaker units 7, it is possible to easily provide the three-dimensional effect or the surround sound effect.

Further, depending on whether listener 30 sits on the chair or on the floor, or depending on the height of listener 30, drive controller 13 has to change the orientation of superdirective loudspeaker 3 in an up-down direction indicated by the thick arrows in FIG. 1. Also in the manner similar to what is described above, drive controller 13 recognizes the position of listener 30, and controls to change the orientation of superdirective loudspeaker 3 in the up-down direction. With such an operation, listener 30 is also able to easily obtain the three-dimensional effect. It should be noted that in this exemplary embodiment, the movement of superdirective loudspeaker 3 in the up-down direction is performed by moving an emission surface of superdirective loudspeaker 3 in the up-down direction. As a result, the sound outputted from superdirective loudspeaker 3 moves in the up-down direction. The movement of superdirective loudspeaker 3 in the up-down direction may be performed by sliding superdirective loudspeaker 3 itself in the up-down direction, or by combination of the rotation and the sliding.

Drive controller 13 continuously monitors the movement of listener 30 using information obtaining device 11, and automatically controls such that the emission surface of superdirective loudspeaker 3 moves up, down, left, or right according to the movement of listener 30 when listener 30 moves. Therefore, even if listener 30 again moves from the optimal state to left or right while listening, it is possible to provide the three-dimensional effect continuously.

In order to perform the above operation, orientation adjustment unit 5 has a function of outputting a current orientation of superdirective loudspeaker 3 to drive controller 13, and a function of outputting an actual movement angle of superdirective loudspeaker 3 according to the control signal from drive controller 13 (an angle output function). Specifically, orientation adjustment unit 5 is provided with a potentiometer (not shown) for a rotating shaft for driving superdirective loudspeaker 3. With this, the current angle and the actual movement angle are outputted from orientation adjustment unit 5 to drive controller 13. However, the angle output function is not limited to the potentiometer, and may be based on a different principle such as optical detection of an angle, for example.

With the configuration and the operation described above, drive controller 13 obtains the listener's position (listening point) based on the listener information from information obtaining device 11, and adjusts the orientation of each superdirective loudspeaker 3 so as to make the listener's position becomes closer to predetermined distance dk. As a result, the directions of the plurality of superdirective loudspeakers 3 are automatically adjusted according to the listener's position. Thus, listener 30 may easily obtain the three-dimensional effect.

Figure 5:
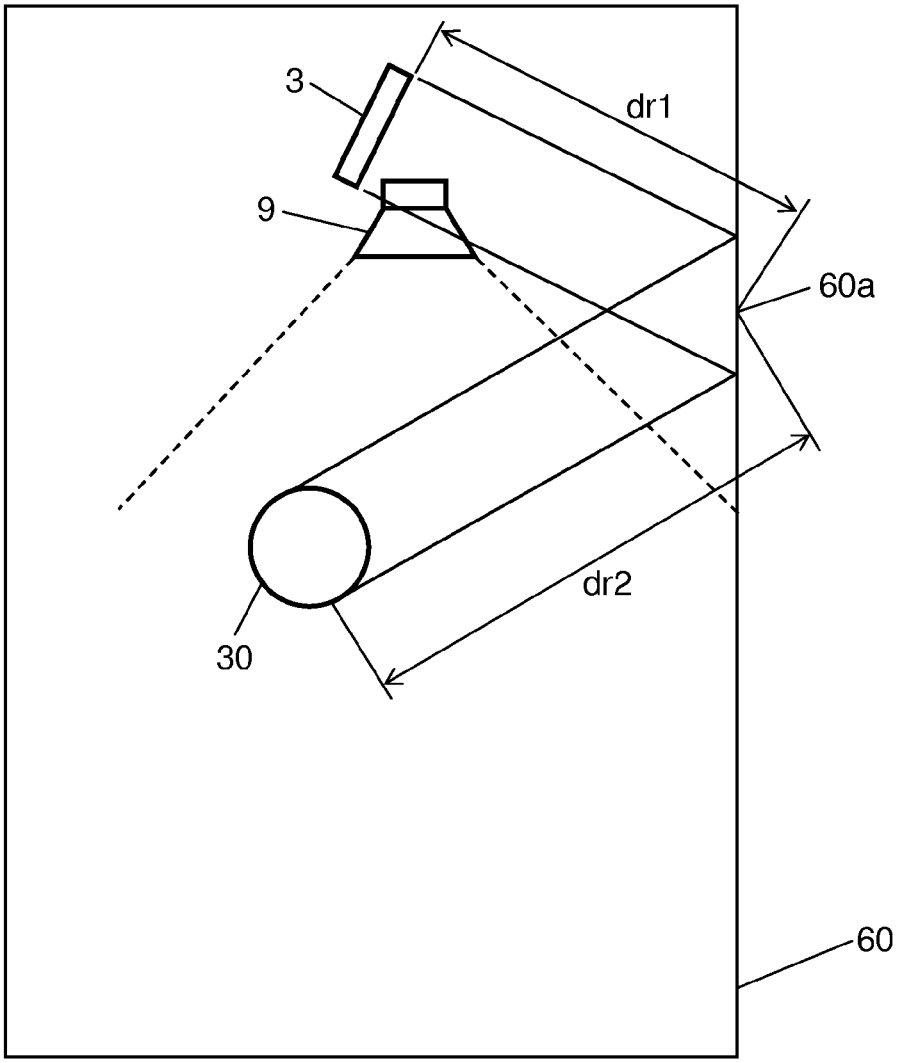
FIG. 5 is a conceptual diagram illustrating a positional relation between the sound field and the listener when reflection is used in the sound reproduction device according to the exemplary embodiment of the present invention.

Next, an operation of sound reproduction device 1 in a case in which linear distance d0 between superdirective loudspeaker 3 and the listener is shorter than distance dk (the position of the peak of the sound pressure of the audible sound) will be described. If the distance of a traveling path of the sound outputted from superdirective loudspeaker 3 to listener 30 is shorter than distance dk, the sound pressure characteristics become extremely poor. Thus, in such a case, sound reproduction device 1 causes the sound outputted from superdirective loudspeaker 3 to reach listener 30 by reflection. With such a configuration, the distance of the traveling path of the sound outputted from superdirective loudspeaker 3 to listener 30 becomes longer when the audible sound outputted from superdirective loudspeaker 3 is reflected than when the sound is directly outputted toward the listener. FIG. 5 is a conceptual diagram illustrating a positional relation between the sound field and the listener when reflection is used in sound reproduction device 1 according to the exemplary embodiment.

Next, an operation of drive controller 13 in the case in which linear distance d0 between superdirective loudspeaker 3 and the listener is shorter than distance dk between the position of the peak of the sound pressure of the audible sound and superdirective loudspeaker 3 will be described. Drive controller 13 compares linear distance d0 with distance dk. Then, if distance d0 is shorter than distance dk, drive controller 13 calculates distance dr of the path of the sound when the sound outputted from superdirective loudspeaker 3 is reflected. Next, drive controller 13 compares a value of the sound pressure at distance d0 with a value of the sound pressure at distance dr in the sound pressure characteristic data shown in FIG. 3 recorded in the memory. If the value of the sound pressure at distance dr is greater than the value of the sound pressure at distance d0, drive controller 13 outputs a control signal instructing to change the orientation of superdirective loudspeaker 3 to orientation adjustment unit 5 so as to cause the sound emitted from superdirective loudspeaker 3 to reach listener 30 after reflected upon reflection surface 60.

In this case, drive controller 13 compares, but not limited to, the value of the sound pressure at distance dr and the value of the sound pressure at distance d0. For example, drive controller 13 may determine that the sound outputted from superdirective loudspeaker 3 is to be reflected when distance dr is closer to distance dk than to distance d0.

Next, how drive controller 13 calculates distance dr of the path of the sound when the sound outputted from superdirective loudspeaker 3 is reflected will be described with reference to FIG. 5. Sound reproduction device 1 records the distance from superdirective loudspeaker 3 to reflection surface 60 (shown in FIG. 5), and a relative angle between the reflection surface and superdirective loudspeaker 3 as data in the memory. Drive controller 13 previously obtains the data from information obtaining device 11 and records the data in the memory. For example, drive controller 13 may obtain the data as initial setting when sound reproduction device 1 is installed at a place for use. Alternatively, the data may be obtained every time sound reproduction device 1 is turned on.

Then, drive controller 13 calculates a rotational angle of superdirective loudspeaker 3 such that the sound reflected upon reflection surface 60 reaches just by the listener's ear. Specifically, drive controller 13 calculates the rotational angle of superdirective loudspeaker 3 in the left-right direction or in the up-down direction, based on the linear distance between superdirective loudspeaker 3 and reflection surface 60, linear distance d0, and the relative angle between superdirective loudspeaker 3 and reflection surface 60. Here, the linear distance between the listener and reflection surface 60 may be used, in place of linear distance d0. Alternatively, both of linear distance d0, and the linear distance between the listener and reflection surface 60 may be used.

With such calculation described above, the position at which the sound outputted from superdirective loudspeaker 3 is reflected (reflection point 60*a*) is determined. Specifically, the path of the sound from superdirective loudspeaker 3 to the listener is determined. Therefore, drive controller 13 is able to calculate linear distance dr1 between superdirective loudspeaker 3 and reflection point 60*a*, and linear distance dr2 between reflection point 60*a* and the listener. Then, drive controller 13 calculates distance dr of the path of the reflected sound by adding distance dr1 and distance dr2.

When there is only one reflection point 60*a*, it is easy to determine reflection point 60*a*. Therefore, drive controller 13 is able to quickly determine the movement angle of superdirective loudspeaker 3. It is possible to cause the sound to quickly follow the movement of the listener.

It is possible to provide more than one reflection point 60*a*. For example, when there are m reflection points 60*a*, drive controller 13 calculates the linear distance between superdirective loudspeaker 3 and first reflection point 60*a*, the linear distance between n-th reflection point 60*a* and (n+1)th reflection point 60*a*, and the linear distance between m-th reflection point 60*a* and the listener. Then, drive controller 13 combines these distances to calculate distance dr of the path of the reflected sound. In this case, it is possible to increase the distance of the path of the sound by having the sound reflect more than one time. Therefore, even when the listener is at a position where linear distance d0 is small, it is possible to make the sound pressure at the listener's position to be closer to the peak of the sound pressure.

Drive controller 13 calculates values of the sound pressures at the listening point respectively when the sound is reflected (n−1) times, n times, and (n+1) times, and compares these values. Then, drive controller 13 determines the number of reflection when the value of sound pressure is largest. When the sound is reflected 0 times (when n=1), the value of sound pressure corresponds to that at linear distance d0. Here, n is a natural number equal to or greater than 1.

As described above, while the three values of the sound pressures when the sound is reflected (n−1) times, n times, and (n+1) times are calculated in this exemplary embodiment, it is sufficient if there are two or more values of the sound pressures to be compared.

As described above, reflection surface 60 may be any of the floor, the walls, and the ceiling. Thus, drive controller 13 selects reflection surface 60. As described above, drive controller 13 previously detects the distances and the angles to each of reflection surfaces 60. Therefore, drive controller 13 is able to recognize the shape and the size of each reflection surface 60 that surrounds the space in which sound reproduction device 1 is placed, and a position of sound reproduction device 1 within this space.

Drive controller 13 determines selectable one of reflection surfaces 60 based on the information relating to the reflection surfaces. When sound reproduction device 1 is placed in a common room, for example, all of the floor, the ceiling, and the walls are selected as reflection surfaces 60. Alternatively, if sound reproduction device 1 is placed outside, the floor or the ground are selected as reflection surface 60.

Drive controller 13 determines reflection point 60*a* for each of selected reflection surfaces 60, and calculates a value of the sound pressure at distance dr via each reflection point 60*a*. Then, drive controller 13 determines one of the reflection surfaces whose value of the sound pressure is highest as reflection surface 60 to be used.

It takes long time to calculate for the plurality of reflection surfaces. Therefore, drive controller 13 divides the space in which sound reproduction device 1 is placed into a plurality of regions, and previously determines reflection surface 60, reflection point 60*a*, or the number of reflection for each of the divided regions. A result of the determination may be recorded in the memory.

When drive controller 13 detects the position of listener 30, and drive controller 13 selects one of the regions that corresponds to the position of listener 30. With the determination of reflection surface 60 using the method of dividing the space into the plurality of regions, it is possible to determine reflection surface 60 corresponding to the position of listener 30, or conditions such as reflection point 60*a* and the number of reflection more quickly as compared to the determination without using the method of dividing the space into the plurality of regions.

It is preferable to perform the determination of reflection surface 60, or the conditions such as reflection point 60*a* and the number of reflection when sound reproduction device 1 is installed, or when sound reproduction device 1 is turned on. With such a configuration, it is possible to determine reflection surface 60, or the conditions such as reflection point 60*a* and the number of reflection.

Further, drive controller 13 controls the orientation of superdirective loudspeaker 3 by, but not limited to, comparing the value of the sound pressure at distance dr with the value of the sound pressure at distance d0. For example, drive controller 13 may perform the determination based on the level of the actual sound pressure at the position of listener 30. In this case, drive controller 13 includes a sound obtaining unit (not shown). The sound obtaining unit may be a device having a sound obtaining part and a communication function.

Here, the sound obtaining part is a transducer for converting sound into an electrical signal, and detects a level of the obtained sound. Further, the sound obtaining unit supplies a level of the sound pressure detected by the sound obtaining part to drive controller 13. With such a configuration, drive controller 13 is able to detect the level of the sound pressure detected by the sound obtaining part wiredly or wirelessly.

The sound obtaining unit may be built within a remote control handled by listener 30. The sound obtaining unit is not limited to a remote control, and examples to be used may include mobile telephones, smartphones, and various video game consoles.

In this case, listener 30 supplies a signal indicating start of the operation from the remote control to sound reproduction device 1. Upon detection of the signal, drive controller 13 starts searching of the level of the sound pressure. Drive controller 13 outputs sound with superdirective loudspeaker 3 directly directed to listener 30, and detects the sound pressure at this time. Further, drive controller 13 has the sound outputted from superdirective loudspeaker 3 reach listener 30 via reflection surface 60, and detects the sound pressure at this time. Then, drive controller 13 selects a path whose level of the sound pressure is highest out of the levels of the detected sound pressures. At this time, the number of the sound pressures to be compared may be two or more.

The remote control may be configured to generate a signal notifying drive controller 13 of the start of a test of the sound pressure. In this case, the remote control may be provided with a key and a circuit for the test of the sound pressure, for example.

Based on the conditions that have been determined as described above, drive controller 13 controls the orientation of superdirective loudspeaker 3. Further, drive controller 13 calculates reflection surface 60, or the conditions such as reflection point 60*a* and the number of reflection as described above based on the listener information obtained by drive controller 13, and adjusts superdirective loudspeaker 3 to an optimal angle.

Next, a case in which there is more than one listener will be described with reference to the drawings.

First, a case in which the number of listeners 30 is equal to the number of superdirective loudspeakers 3 will be described.

Figure 6:
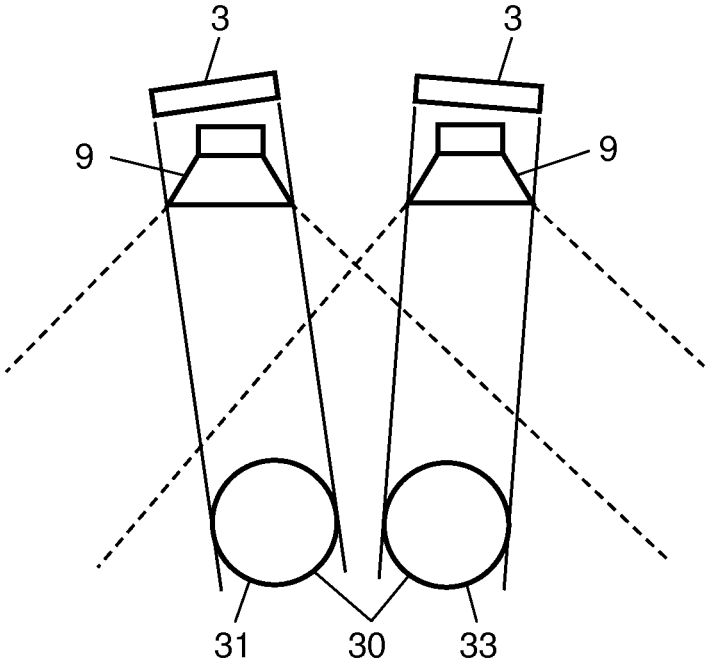
FIG. 6 is a conceptual diagram illustrating a positional relation between the sound field and the listeners when the number of the listeners is equal to the number of the superdirective loudspeakers in the sound reproduction device according to the exemplary embodiment of the present invention.

FIG. 6 is a conceptual diagram illustrating a positional relation between the sound field and listeners 30 in the case in which the number of listeners 30 is equal to the number of superdirective loudspeakers 3. In FIG. 6, the same components as shown in FIG. 4 and FIG. 5 are denoted by the same reference numerals, and detailed descriptions of these components are omitted. Drive controller 13 and information obtaining device 11 are the same as those shown in FIG. 1 and FIG. 2, and not shown in FIG. 6.

As illustrated in FIG. 6, in sound reproduction device 1 according to this exemplary embodiment, the number of listeners 30 is equal to the number of superdirective loudspeakers 3. A case in which there are two superdirective loudspeakers 3 and two listeners 30 will be taken as an example. Left one of listeners 30 is called left listener 31, and right one of listeners 30 is called right listener 33.

Drive controller 13 performs face image recognition of the listeners based on an image obtained from information obtaining device 11, and determines the number and positions of listeners 30. Then, if the number of listeners 30 is determined to be equal to the number of superdirective loudspeakers 3, drive controller 13 makes correspondence between superdirective loudspeakers 3 and listeners 30 one on one, and controls each orientation adjustment unit 5. Specifically, drive controller 13 causes orientation adjustment unit 5 to direct superdirective loudspeakers 3 such that an output from left superdirective loudspeaker 3 reaches left listener 31 and an output from right superdirective loudspeaker 3 reaches right listener 33. The selection of the reflection surface and the reflection path of drive controller 13 and the control of each orientation adjustment unit 5 are the same as those described above. With such an operation, both left listener 31 and right listener 33 are able to easily obtain the three-dimensional effect.

In the above configuration, the sound information from left superdirective loudspeaker 3 is mainly heard by left listener 31, and hardly heard by right listener 33. Therefore, left listener 31 hears the sound information from left superdirective loudspeaker 3, and the sound information from two loudspeakers 9. While the accuracy in this case is reduced as compared to the case in which one listener 30 hears the sound information from two superdirective loudspeakers 3 as illustrated in FIG. 4, even when one listener 30 hears the sound information from one superdirective loudspeaker 3 as illustrated in FIG. 6, left and right listener 30 are able to easily hear the sound information providing the three-dimensional effect.

In this manner, when the number of listeners 30 and the number of superdirective loudspeakers 3 is equal, it is possible for all of the plurality of listeners 30 to easily hear the sound information providing the three-dimensional effect by controlling the orientations of superdirective loudspeakers 3 so as to correspond to the listens one on one.

Next, a case in which the number of listeners 30 is greater than the number of superdirective loudspeakers 3 will be described.

Figure 7A:
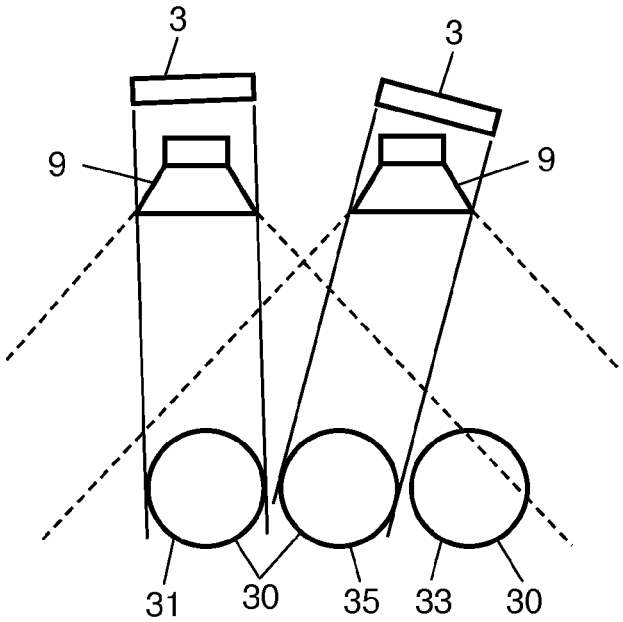
FIG. 7A is a conceptual diagram illustrating a positional relation between the sound field and the listeners when the number of the listeners is greater than the number of the superdirective loudspeakers in the sound reproduction device according to the exemplary embodiment of the present invention.
Figure 7B:
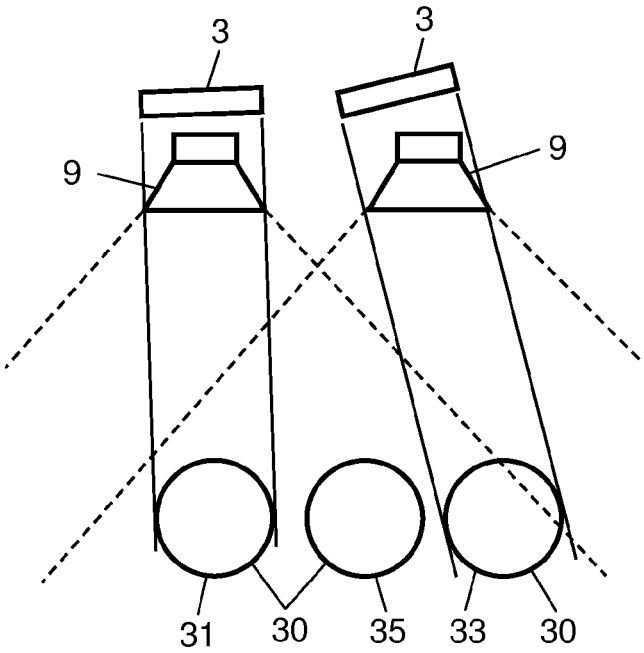
FIG. 7B is another conceptual diagram illustrating a positional relation between the sound field and the listeners when the number of the listeners is greater than the number of the superdirective loudspeakers in the sound reproduction device according to the exemplary embodiment of the present invention.

FIG. 7A and FIG. 7B are conceptual diagrams respectively illustrating positional relations between the sound field and listeners 30 when the number of listeners 30 is greater than the number of superdirective loudspeaker 3. In the following description, a case in which there are two superdirective loudspeakers 3 and three listeners 30 will be taken as an example. One of three listeners 30 positioned in the middle is referred to as central listener 35.

When drive controller 13 determines that the number of superdirective loudspeakers 3 is smaller than the number of listeners 30, drive controller 13 makes correspondence between each superdirective loudspeaker 3 and any of listeners 30 one on one, and controls each orientation adjustment unit 5. In this case, drive controller 13 selects one of listeners 30 in the following manner.

First, a case in which the plurality of listener 30 are positioned side by side will be described. In the following description, three listeners 30 are positioned substantially side by side will be taken as an example. In this case, the distances between superdirective loudspeakers 3 and listeners 30 are not largely different between the three. Therefore, values of the sound pressures of superdirective loudspeakers 3 at the positions of the three listeners are not much different. Accordingly, in such a case, drive controller 13 makes correspondence between any two of listeners 30 and superdirective loudspeakers 3 one on one, and controls orientation adjustment units 5. For example, FIG. 7A shows a case in which drive controller 13 has selected left listener 31 and central listener 35. In this case, left listener 31 and central listener 35 are able to easily hear the sound information providing the three-dimensional effect. FIG. 7B shows a case in which drive controller 13 has selected left listener 31 and right listener 33. In this case, left listener 31 and right listener 33 are able to easily hear the sound information providing the three-dimensional effect. It should be appreciated that right listener 33 and central listener 35 may be selected. Here, if listeners 30 are at a position from the loudspeakers with a distance shorter than linear distance dk, the sound reaches listeners 30 after being reflected.

Further, in this exemplary embodiment, the number of listeners 30 is, but not limited to, three. When there are four or more listeners 30, any two of four listeners 30 are selected appropriately in the same manner.

Figure 8A:
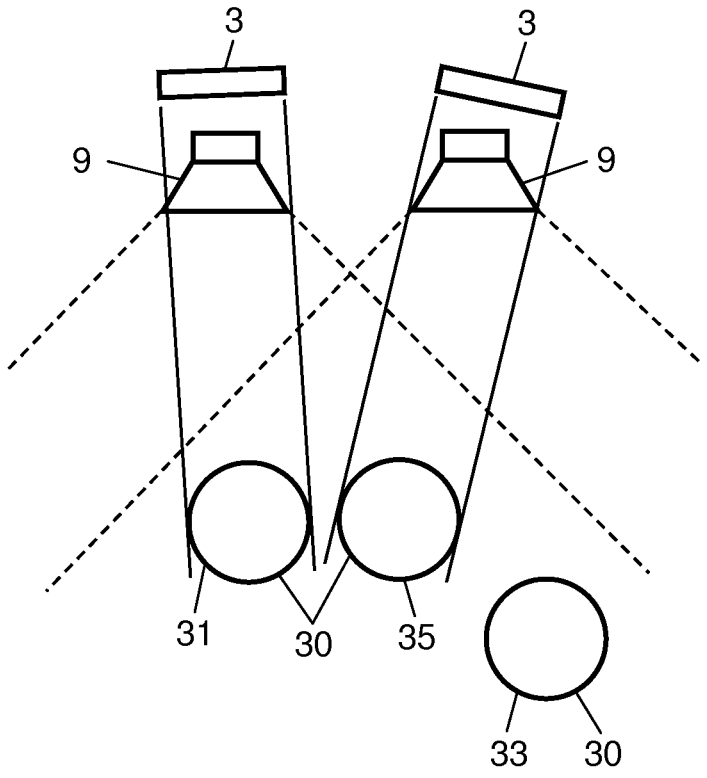
FIG. 8A is another conceptual diagram illustrating a positional relation between the sound field and the listeners when the number of the listeners is greater than the number of the superdirective loudspeakers in the sound reproduction device according to the exemplary embodiment of the present invention.

FIG. 8A is another conceptual diagram illustrating a positional relation between the sound field and the listeners when the number of listeners 30 is greater than the number of superdirective loudspeaker 3. In this case, the plurality of listeners 30 includes those closer to superdirective loudspeakers 3 and those farther from the loudspeakers.

For example, one of listeners 30 is farther from or closer to superdirective loudspeakers 3 than the remaining two are, and distant from the position at which the peaks of the sound pressures of the audible sound from superdirective loudspeaker 3 correspond. In the following description, a case in which right listener 33 is distant from the position at which the peaks of the sound pressures of the audible sound from superdirective loudspeakers 3 correspond than left listener 31 or central listener 35 is will be taken as an example.

In this case, right listener 33 may not obtain a sufficient three-dimensional effect of the sound information even if superdirective loudspeaker 3 is moved to face right listener 33. Therefore, drive controller 13 obtains the distances and the positions of three listeners 30 from superdirective loudspeakers 3. Then, drive controller 13 makes correspondence between superdirective loudspeakers 3 and listeners 30 one on one in a descending order of the sound pressures of the sound outputted from superdirective loudspeaker 3 at the positions where listeners 30 are at. Then, drive controller 13 controls orientation adjustment unit 5 such that superdirective loudspeaker 3 faces one listener 30 that is made correspondent. Here, drive controller 13 may make correspondence between superdirective loudspeakers 3 and listeners 30 one on one in an ascending order of values of distance dk to listeners 30.

Figure 8B:
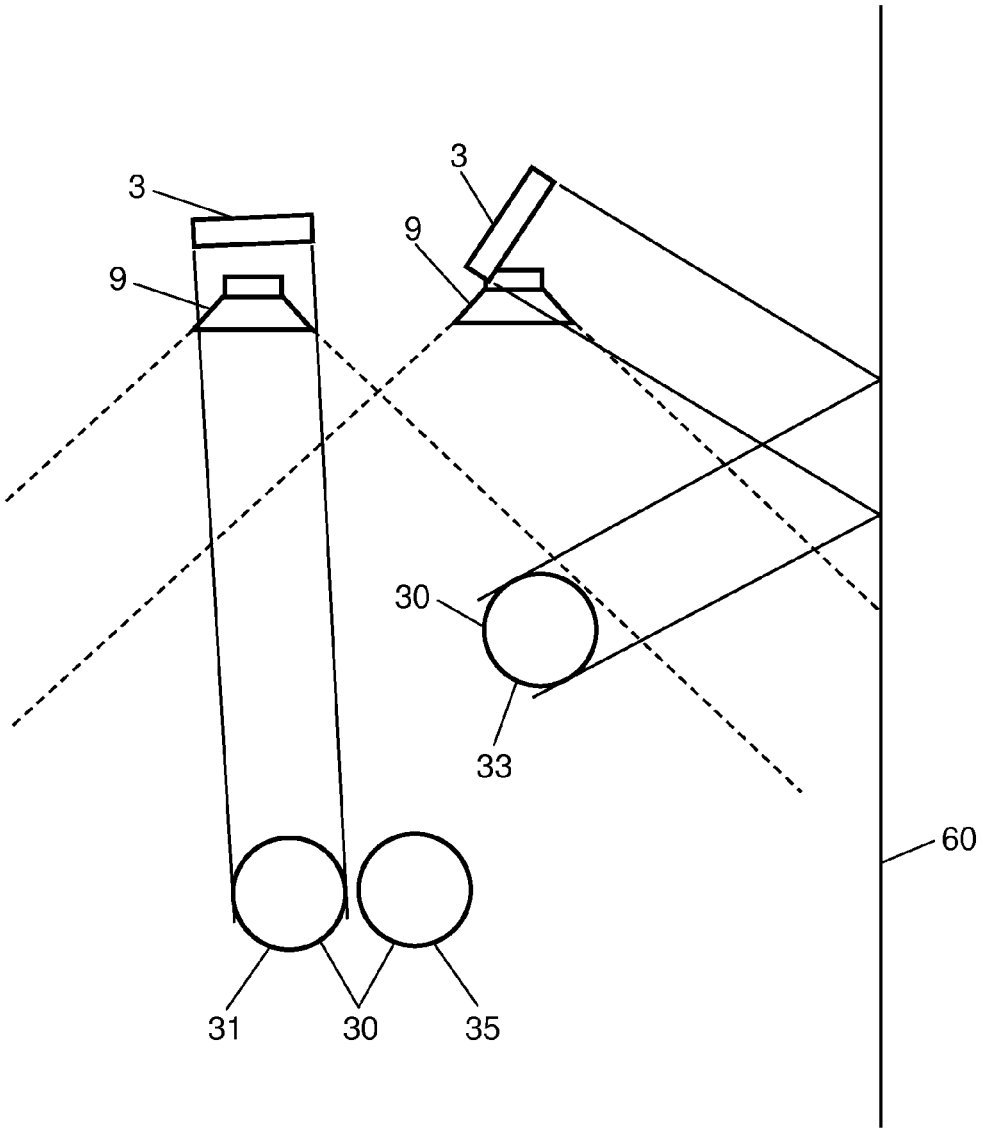
FIG. 8B is another conceptual diagram illustrating a positional relation between the sound field and the listeners when the number of the listeners is greater than the number of the superdirective loudspeakers in the sound reproduction device according to the exemplary embodiment of the present invention.

FIG. 8B shows a case opposite of the case shown in FIG. 8A. FIG. 8B is another conceptual diagram illustrating a positional relation between the sound field and listeners 30 when the number of listeners 30 is greater than the number of superdirective loudspeakers 3. The same applies to a case in which, for example, as illustrated in FIG. 8B, right listener 33 is closer to superdirective loudspeakers 3 than left listener 31 or central listener 35, and is at a position that is closer to superdirective loudspeakers 3 than the peaks of the sound pressures of the audible sound from superdirective loudspeaker 3 are. In this case, the sound pressure at the position of right listener 33 is calculated by the path for the sound outputted from superdirective loudspeaker 3 and reflected upon reflection surface 60.

In this manner, sound reproduction device 1 according to the exemplary embodiment illustrated in FIG. 8A automatically direct superdirective loudspeakers 3 to face left listener 31 and central listener 35 who are able to effectively obtain the three-dimensional effect of the audio signals. As a result, left listener 31 and central listener 35 are able to easily listen to the sound information providing the three-dimensional effect.

Figure 9:
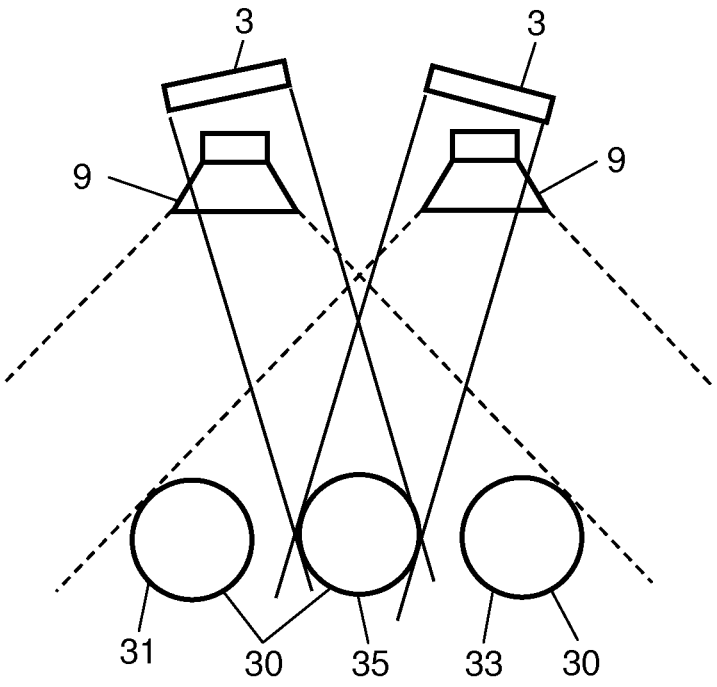
FIG. 9 is another conceptual diagram illustrating a positional relation between the sound field and the listeners when the number of the listeners is greater than the number of the superdirective loudspeakers in the sound reproduction device according to the exemplary embodiment of the present invention.

FIG. 9 is another conceptual diagram illustrating a positional relation between the sound field and the listeners when the number of the listeners is greater than the number of the superdirective loudspeakers. Sound reproduction device 1 according to the exemplary embodiment selects listeners 30 in a manner different from the previous examples. Drive controller 13 controls orientation adjustment unit 5 by, when the plurality of listeners 30 are positioned substantially side by side, making correspondence between superdirective loudspeakers 3 and a previously registered prioritized listener. With this, prioritized listener 30 is able to obtain the sound information providing the three-dimensional effect.

In the following, a case in which central listener 35 is prioritized out of listeners 30 will be taken as an example. Drive controller 13 displays images of listeners 30 that has been obtained in image display device 20. Then, the image of central listener 35 is selected and central listener 35 is registered as a prioritized listener.

With the above configuration, drive controller 13 controls the orientation of superdirective loudspeaker 3 to follow the movement of central listener 35 even if the position of central listener 35 changes. Therefore, to central listener 35, sound information providing the three-dimensional effect is supplied in a stable manner.

In the determination of priorities, listener 30 having lower priorities such as second and further may be determined. With such a configuration, when central listener 35 leaves the spot and drive controller 13 is not able to recognize the position of central listener 35, drive controller 13 is able to control orientation adjustment units 5 such that superdirective loudspeakers 3 face toward the next prioritized listener. With this, the listeners are able to obtain the sound information providing the three-dimensional effect according to the priorities.

Further, in FIG. 9, drive controller 13 makes correspondence such that both of two superdirective loudspeakers 3 face toward prioritized central listener 35. Therefore, only central listener 35 is able to listen to the sound information providing the three-dimensional effect.

As illustrated in FIG. 7A and FIG. 7B, drive controller 13 may control orientation adjustment units 5 such that two superdirective loudspeakers 3 face toward the two listeners in the prioritized order. In the configurations shown in FIG. 7A and FIG. 7B, as many listeners 30 as possible are able to obtain the sound information providing the three-dimensional effect.

If the number of listeners 30 is smaller than the number of superdirective loudspeakers 3, as described with reference to FIG. 4, for example, drive controller 13 may control each orientation adjustment unit 5 making correspondence between two or more superdirective loudspeakers 3 with one listener 30. With this, listener 30 made correspondent with two or more superdirective loudspeaker 3 is able to effectively feel the surround sound effect, and to easily listen to the sound information providing the three-dimensional effect.

For example, when there are two listeners 30 and three superdirective loudspeakers 3, drive controller 13 selects random listener 30, listener 30 closer to distance dk, or prioritized listener 30, and makes correspondence between this listener 30 and two of three superdirective loudspeakers 3 one on one. Then, drive controller 13 controls orientation adjustment units 5 by making correspondence between the remaining one of superdirective loudspeakers 3 with any of listeners 30. In this manner, drive controller 13 controls each orientation adjustment unit 5 so that there are no superdirective loudspeaker 3 that is not correspondent with any of listeners 30. With this, the sound information from superdirective loudspeakers 3 reaches listener 30, and thus superdirective loudspeakers 3 are effectively utilized. The number of listeners 30 and the number of superdirective loudspeakers 3 are not limited to the above examples. With such a configuration and an operation, it is possible to provide the sound information from each of superdirective loudspeakers 3 to as many listeners 30 as possible. Therefore, the plurality of listeners 30 listening to the sound information are able to easily obtain the three-dimensional effect.

Figure 10:
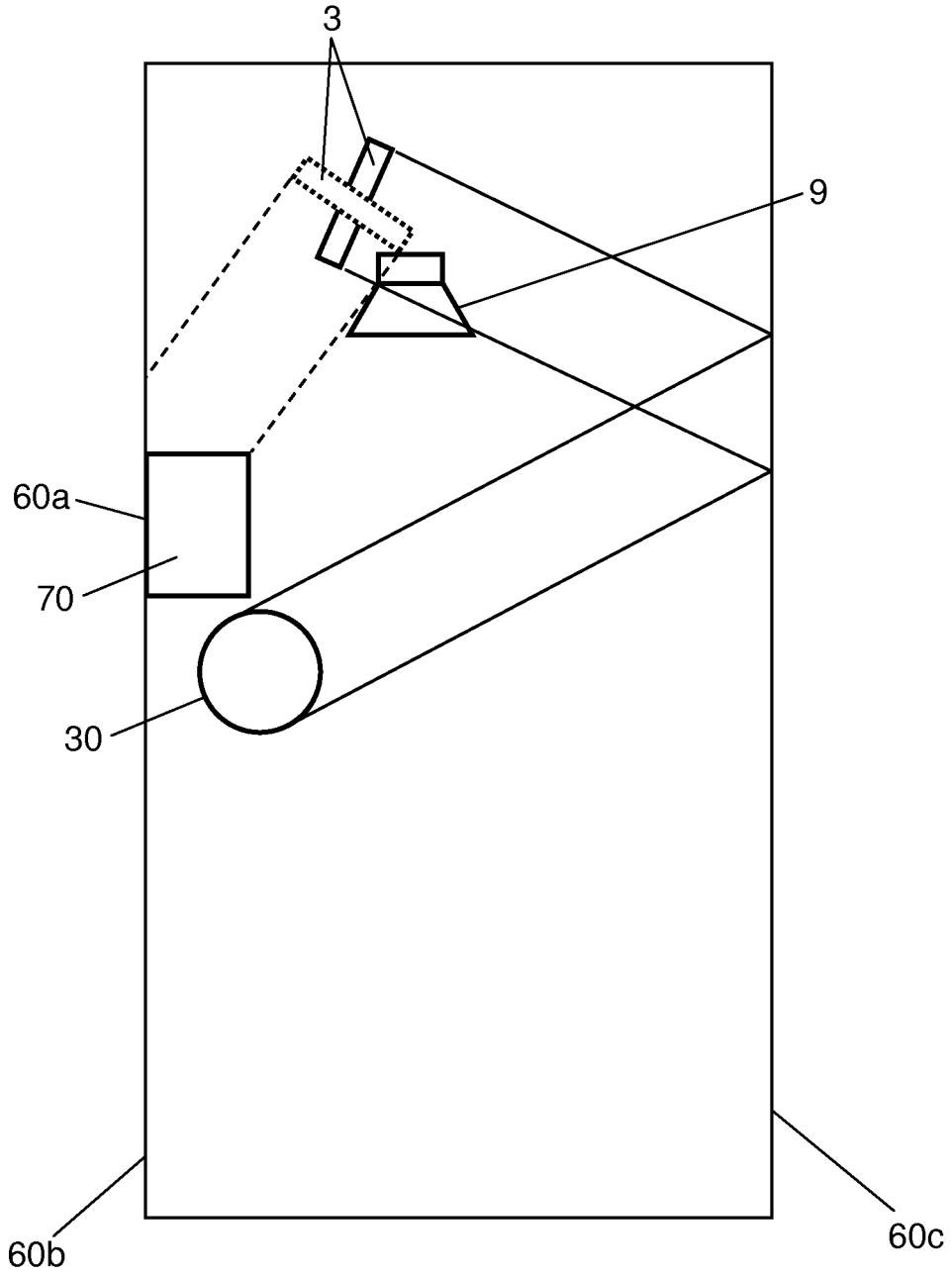
FIG. 10 is a conceptual diagram illustrating a positional relation between the sound field and the listener when reflection is used in the sound reproduction device according to the exemplary embodiment of the present invention.

FIG. 10 is a conceptual diagram illustrating a positional relation between the sound field and the listener when reflection is used in sound reproduction device 1. For example, when there is obstacle 70 such as a projection near reflection point 60*a*, the sound outputted from superdirective loudspeaker 3 is blocked by obstacle 70 and may not reach listener 30. When reflection surface 60 is the floor, obstacle 70 is a desk or a shelf, for example. When reflection surface 60 is the ceiling, obstacle 70 is a lamp, for example. Further, when reflection surface 60 is the walls, obstacle 70 is furniture, for example.

Therefore, drive controller 13 of sound reproduction device 1 according to this exemplary embodiment determines whether or not there is obstacle 70 along the path of the sound outputted from superdirective loudspeaker 3 to listener 30. Then, when obstacle 70 is detected, drive controller 13 switches reflection surface 60. For example, drive controller 13 switches from reflection surface 60*b* to reflection surface 60*c*. With this configuration, even if there is obstacle 70, listener 30 is able to easily obtain the three-dimensional effect.

Modified Example of Exemplary Embodiment

Figure 11A:
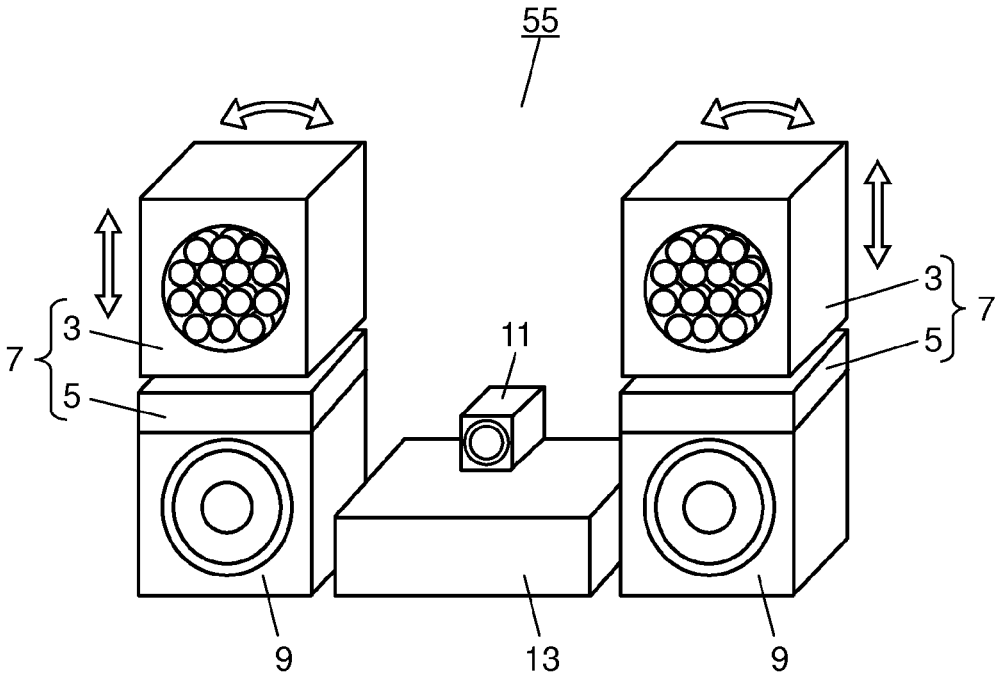
FIG. 11A is a schematic diagram of a configuration of a sound reproduction device according to a modified example of the exemplary embodiment of the present invention.
Figure 11B:
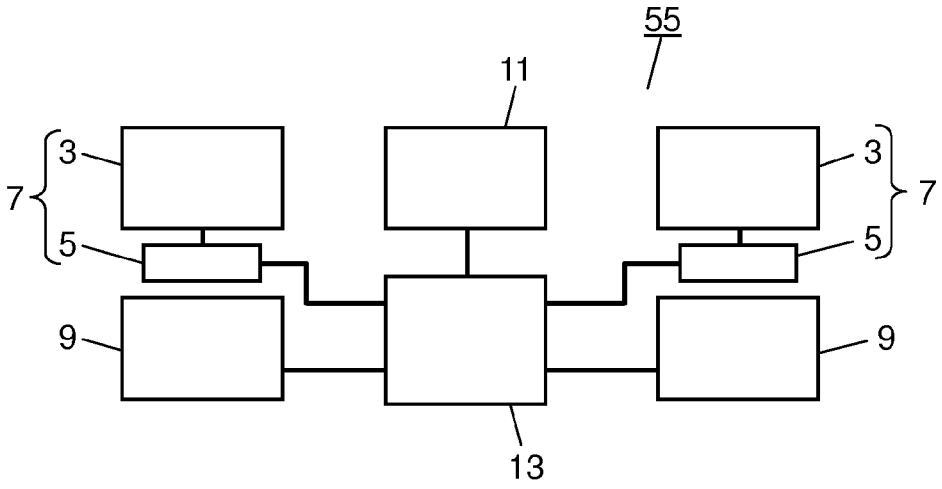
FIG. 11B is a block diagram of the sound reproduction device according to a modified example of the exemplary embodiment of the present invention.

Next, a modified example of the exemplary embodiment will be described with reference to FIG. 11A and FIG. 11B. FIG. 11A is a schematic diagram of a configuration of sound reproduction device 55 according to a different example of this exemplary embodiment. FIG. 11B is a block diagram of another sound reproduction device 55 according to a different example of this exemplary embodiment. In sound reproduction device 55, components other than image display device 20 are the same as those in sound reproduction device 1.

While sound reproduction device 1 includes image display device 20 according to the exemplary embodiment illustrated in FIG. 1 and FIG. 2, it is not necessary to provide image display device 20, as illustrated in FIG. 11A and FIG. 11B.

Sound reproduction device 55 may be attached to existing televisions and personal computers, or mounted on audio equipment. Therefore, adding sound reproduction device 55 to known audio visual equipment allows the listeners to easily obtain the three-dimensional effect.

In the exemplary embodiment, the example in which there are two superdirective loudspeaker units 7 is described. However, the present invention is not limited to such an example, and the sound reproduction device of the present invention may be configured by one superdirective loudspeaker unit 7, or three or more superdirective loudspeaker units 7. When there are three or more superdirective loudspeaker units 7, drive controller 13 causes orientation adjustment unit 5 included in each of superdirective loudspeaker units 7 to perform complicated and subtle adjustment of the directions of a large number of superdirective loudspeakers 3 for listener 30. Therefore, with sound reproduction device 1 having a large number of superdirective loudspeakers 3, listener 30 is able to easily obtain the three-dimensional effect.

When there is only one superdirective loudspeaker unit 7, listener 30 is able to easily obtain the sound information providing the three-dimensional effect. However, in order to more effectively perform reproduction with the three-dimensional effect having the surround sound effect as described above, it is preferable to provide more than one superdirective loudspeaker unit 7.

Further, according to this exemplary embodiment, there are two loudspeakers 9, similarly to superdirective loudspeaker units 7. However, it is possible to employ a configuration in which only a subwoofer in the surround sound system is loudspeaker 9, and the remaining loudspeakers are superdirective loudspeakers 3. In this case, there is one loudspeaker 9. In addition, there may be three or more loudspeakers 9.

According to this exemplary embodiment, a camera is used as information obtaining device 11, but the present invention is not limited to this example. As long as the position of listener 30 may be detected, an infrared sensor detecting the position of listener 30 using temperature may be used, for example.

INDUSTRIAL APPLICABILITY

The sound reproduction device according to the present invention allows the listener to easily obtain the three-dimensional effect, and therefore, is particularly useful as sound reproduction devices or the like using superdirective loudspeakers.

What is claimed is:

1. A sound reproduction device comprising:

a first loudspeaker having directionality utilizing a parametric effect;

a second loudspeaker having directionality broader than that of the first loudspeaker;

an orientation adjustment unit configured to change an orientation of the first loudspeaker;

an information obtaining device configured to obtain positional information of a listener; and a drive controller electrically connected to the first loudspeaker, the second loudspeaker, the orientation adjustment unit, and the information obtaining device, and configured to control the orientation of the first loudspeaker based on the positional information of the listener, wherein:

the drive controller controls the orientation adjustment unit so that if a distance between the first loudspeaker and the listener is determined to be shorter than a distance between the first loudspeaker and a position of a peak of a sound pressure of audible sound in a state in which the first loudspeaker faces the listener, the orientation adjustment unit changes the orientation of the first loudspeaker in such a manner that the first loudspeaker changes from a state in which audible sound from the first loudspeaker directly reaches the listener to a state in which the audible sound from the first loudspeaker reaches the listener via a reflection surface.

2. The sound reproduction device according to claim 1, wherein the drive controller controls the orientation of the first loudspeaker based on the positional information of the listener so that a sound field of the audible sound from the first loudspeaker overlaps with a sound field of audible sound from the second loudspeaker at the listener's position.

3. The sound reproduction device according to claim 1, wherein the drive controller controls the orientation of the first loudspeaker so that a sound pressure of the audible sound from the first loudspeaker is greater than a sound pressure of the audible sound from the second loudspeaker at the listener's position.

4. The sound reproduction device according to claim 1, wherein the first loudspeaker includes a plurality of loudspeakers, the information obtaining device includes information relating to a number of the listeners, and the drive controller controls the orientation adjustment unit so that:

when the number of the listeners is one, the first loudspeaker corresponds to the listener;

when the number of the listeners is plural and the number of the plurality of listeners is equal to the number of the plurality of loudspeakers, the plurality of loudspeakers respectively corresponds to the plurality of listeners; and when the number of the listeners is plural and the number of the plurality of listeners is greater than the number of the plurality of loudspeakers, each of the plurality of loudspeakers corresponds to any one of the plurality of listeners.

5. The sound reproduction device according to claim 4, wherein when the number of the listeners is plural, the drive controller obtains a distance between each of the plurality of listeners and the first loudspeaker, and controls the orientation adjustment unit so that the first loudspeaker faces one of the plurality of listeners at a position closer to a peak of the sound pressure of the first loudspeaker.

6. The sound reproduction device according to claim 4, wherein when the number of the listeners is plural, the drive controller controls the orientation adjustment unit so that the loudspeakers correspond to a listener having a higher priority and having been registered in advance.

7. A sound reproduction device comprising:

a first loudspeaker having directionality utilizing a parametric effect;

a second loudspeaker having directionality broader than that of the first loudspeaker;

an orientation adjustment unit configured to change an orientation of the first loudspeaker;

an information obtaining device configured to obtain positional information of a listener; and a drive controller electrically connected to the first loudspeaker, the second loudspeaker, the orientation adjustment unit, and the information obtaining device, and configured to determine the orientation of the first loudspeaker based on the positional information of the listener, wherein the drive controller compares a first sound pressure with a second sound pressure, the first sound pressure being measured at the listener's position and its sound traveling through a path between the first loudspeaker directly facing the listener and the listener, the second sound pressure being measured at the listener's position and its sound traveling through a path between the first loudspeaker and the listener via a reflecting surface, the audible sound from the first loudspeaker directly reaches the listener when the first sound pressure is greater than the second sound pressure, and the audible sound from the first loudspeaker reaches the listener via the reflection surface when the second sound pressure is greater than the first sound pressure.

8. The sound reproduction device according to claim 7, wherein the first loudspeaker includes a plurality of loudspeakers, the information obtaining device includes information relating to a number of the listeners, and the drive controller controls the orientation adjustment unit so that:

when the number of the listeners is one, the first loudspeaker corresponds to the listener;

when the number of the listeners is plural and the number of the plurality of listeners is equal to the number of the plurality of loudspeakers, the plurality of loudspeakers respectively correspond to the plurality of listeners; and when the number of the listeners is plural and the number of the plurality of listeners is greater than the number of the plurality of loudspeakers, each of the plurality of loudspeakers corresponds to any one of the plurality of listeners.

9. The sound reproduction device according to claim 8, wherein when the number of the listeners is plural, the drive controller obtains a distance between each of the plurality of listeners and the first loudspeaker, and controls the orientation adjustment unit so that the first loudspeaker corresponds to one of the plurality of listeners at a position closer to a peak of the sound pressure of the first loudspeaker.

10. The sound reproduction device according to claim 8, wherein when the number of the listeners is plural, the drive controller controls the orientation adjustment unit so that the loudspeakers correspond to a listener having a higher priority and having been registered in advance.

* * * * *